US008002917B2

(12) United States Patent
Boddu et al.

(10) Patent No.: US 8,002,917 B2
(45) Date of Patent: Aug. 23, 2011

(54) ADJUSTING YIELD OF A MANUFACTURING PROCESS FOR ENERGETIC COMPOUNDS THROUGH SOLUBILITY MODIFICATION

(75) Inventors: Veera M. Boddu, Champaign, IL (US); Reddy Damavarapu, Hackettstown, NJ (US); Krishnaiah Abburi, Tirupati (IN)

(73) Assignee: The United States of America as represented by the Secretary of the Army, Washington, DC (US)

( * ) Notice: Subject to any disclaimer, the term of this patent is extended or adjusted under 35 U.S.C. 154(b) by 453 days.

(21) Appl. No.: 12/367,562

(22) Filed: Feb. 9, 2009

(65) Prior Publication Data

US 2010/0200128 A1 Aug. 12, 2010

(51) Int. Cl.
*C06B 25/34* (2006.01)
*D03D 23/00* (2006.01)

(52) U.S. Cl. ..... 149/92; 149/109.6

(58) Field of Classification Search ..... 149/92, 149/109.6

See application file for complete search history.

(56) References Cited

U.S. PATENT DOCUMENTS

| | | | |
|---|---|---|---|
| 4,638,065 | A | 1/1987 | Svensson et al. |
| 4,767,854 | A | 8/1988 | Lewicki |
| 5,099,008 | A | 3/1992 | Voigt et al. |
| 5,360,478 | A | 11/1994 | Krukonis et al. |
| 2005/0072503 | A1 | 4/2005 | Smith et al. |
| 2006/0272756 | A1 | 12/2006 | Kneisl et al. |

*Primary Examiner* — Aileen B Felton
(74) *Attorney, Agent, or Firm* — Earl H. Baugher, Jr.

(57) ABSTRACT

A method of adjusting the yield of a manufactured compound comprising primarily two energetic materials to yield a product comprising primarily one of the two energetic materials. Specifically, embodiments of the present invention provide a method of purifying a compound primarily comprising RDX and HMX to achieve a desired purity of RDX with an acceptable yield percentage. By adding sufficient acetonitrile (ACN) to the manufactured compound to dissolve it and form a solution; adding a pre-specified volume of water to the resultant solution and stirring sufficiently to precipitate at least the RDX; separating and drying the precipitate, a pre-specified purity and yield percentage of RDX may be obtained by varying the volume of water added. The process uses relatively environmentally benign recyclable solvents at ambient temperature and pressure reducing both environmental impact and energy costs.

20 Claims, 2 Drawing Sheets

ADJUSTING YIELD OF A MANUFACTURING PROCESS FOR ENERGETIC COMPOUNDS THROUGH SOLUBILITY MODIFICATION

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Bea Shahin at 217 373-7234.

BACKGROUND

Explosive compounds with reduced sensitivity characteristics are desirable to provide safe loading, packing and assembly operations, in particular for military applications. The two most widely used explosive compounds, Research Department Composition X (RDX) (1,3,5-Trinitro-1,3,5-triazacyclohexane, also known as cyclotrimethylene trinitramine) and High Molecular Weight RDX (HMX) (1,3,5,7-tetranitro-1,3,5,7-tetraazacyclooctane, also known as cyclotetramethylene tetranitramine), each have properties sought for modern munitions. Pure RDX is relatively insensitive and desirable for that characteristic while HMX is not. RDX may be produced several ways, the most common being the continuous Bachmann Process that involves reacting hexamine with nitric acid, ammonium nitrate, glacial acetic acid, and acetic anhydride. Bachmann et al., *J. Am. Chem. Soc.,* 71, 1842, (1979). The resultant product is filtered and re-crystallized to form RDX containing a typically acceptable 8-12% HMX. L. A. Nock and R. Doherty, *Reduced Sensitivity RDX: US and International Efforts,* 39$^{th}$ *Annual Gun & Ammunition/Missiles & Rockets Conference* 7 Exhibition, Baltimore, Md., 13-16 Apr. 2004. The sensitivity of the final product depends on the relative proportions of RDX and HMX, sensitivity generally increasing with increased HMX. HMX, along with solvent inclusions, is the main impurity causing increased sensitivity. Lionel Borne and Helmut Ritter, *HMS as an Impurity in RDX Particles: Effect on the Shock Sensitivity of Formulations Based on RDX; Propellants, Explosives, Pyrotechnics.,* 31, 482, 2006. Thus, to increase RDX content and reduce sensitivity of the resultant RDX product, a better method is required to selectively eliminate HMX from the initially formed RDX/HMX combination.

Attempts yielding marginal success in reducing the amount of HMX in the initial formulation of RDX included simple re-crystallization by freezing; selective adsorption of RDX or HMX on various sorbents (e.g., granular activated carbon (GAC), XAD™ resins, alginates, and the like), membrane separation; and phase separation by adding a hydrophilic solvent.

A goal met by select embodiments of the present invention is purifying an initial product having about 90% RDX and about 10% HMX to a final product having greater than about 99% RDX depending on the desired yield percentage.

DETAILED DESCRIPTION

Figure 1:
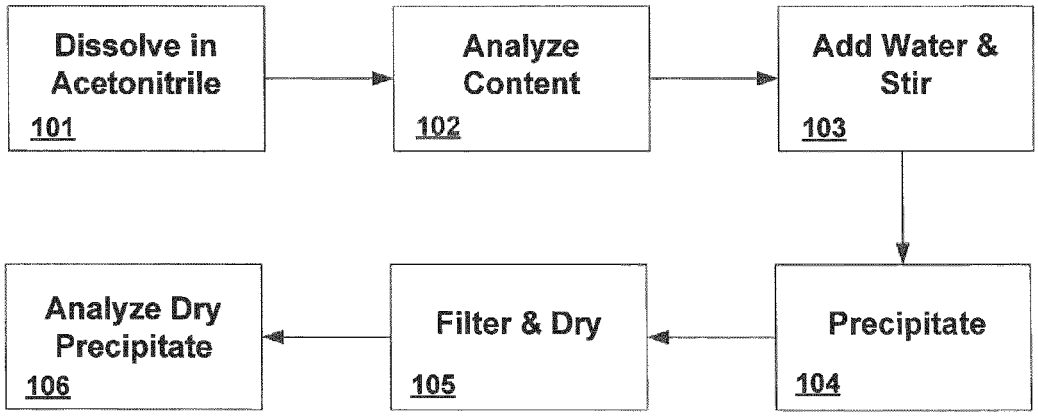
FIG. 1 is a block diagram of a method employing a select embodiment of the present invention to remove HMX from an RDX formulation.

Select embodiments of the present invention provide a process for purifying RDX from an initial compound comprising RDX and impurities that include HMX. Select embodiments of the present invention, in particular, include a method of purifying a mixture of approximately 90% RDX and 10% HMX to obtain RDX with a purity approaching about 100%.

Select embodiments of the present invention employ phase separation to selectively separate (e.g., by precipitation from liquids) a compound from a homogenous system into two (or more) phases. By solubilizing impure (crude) RDX in a suitable solvent and phase separating the resultant intermediate product by adding water, a final RDX composition approaching about 100% purity may be obtained.

Select embodiments of the present invention add sufficient acetonitrile (ACN), $CH_3CN$, to a compound comprising RDX and HMX to dissolve the compound and form a solution of RDX and HMX in acetonitrile. Water is added to the solution to precipitate the RDX and the precipitate is then filtered and dried.

The phase separation occurs because of the difference in solubility of RDX and HMX in a "good solvent," such as ACN, and modification of the solubility of RDX in a solution formed from a good solvent and a "poor solvent" (for an energetic compound such as RDX) such as water. That is, with select embodiments of the present invention, a good solvent is one that RDX is readily solubilized in and a "poor solvent" is one that RDX is not readily solubilized in, e.g., water. In select embodiments of the present invention, the solubility of RDX is high in the good solvent, e.g., ACN, and the good solvent and poor solvent, e.g., water, are miscible so that separate liquid phases are not formed during phase separation. Preferably, the major impurity, in particular HMX, is more soluble in the poor solvent, e.g., water, than is RDX.

For select embodiments of the present invention, a first characteristic of a suitable good solvent is one that demonstrates a high solubility for each of the components of the RDX/HMX compound. Further, a good solvent should also have a low vapor pressure under conditions used for phase separation, in particular, ambient atmospheric pressure and temperature (i.e., about 20° C. to about 25° C.), to reduce vaporization prior to separation. A solvent should also have good transport properties, such as diffusivity and viscosity. The above properties contribute to the kinetics of solubilization and evaporation, thereby facilitating thorough mixing of all components, including RDX, HMX and any other solvents that may be employed as well as the removal of solvents in the final stage. Finally, it is advantageous for candidate solvents to minimize airborne pollution and reduce hazards from handling while being relatively inexpensive. ACN, having a relatively low boiling point (81.6° C.) and an enthalpy of vaporization of 31.3 kJ/mol, meets requirements for a good solvent in that it readily dissolves both RDX and HMX, is miscible with the preferred poor solvent, water, and has a relatively low vapor pressure. ACN also possesses excellent transport properties with a high diffusivity and low viscosity. While other solvents, such as acetone, cyclohexanone or dimethylsulfoxide (DMSO), demonstrate suitable solubility characteristics, they do not possess all of the required characteristics, such as a suitable vapor pressure, above average toxicity, poor transport properties or cost.

The solubility of RDX and HMX in water and ACN was determined experimentally at ambient temperature and pressure as shown in Table 1.

TABLE 1

Solubility of RDX and HMX in water and ACN at 23° C.

| | SOLUBILITY (mg/L) | |
|---|---|---|
| SOLVENT | RDX | HMX |
| Water | 45.87 | 3.49 |
| ACN | 48,690 | 17,150 |

Select embodiments of the present invention provide a method of altering a compound comprising primarily of a first and a second energetic material to adjust yield and concentration of the first energetic material in a final product resultant from employing the method. Select embodiments of the present invention comprise: combining the compound with a pre-specified solvent to form a first solution; analyzing a sample of the first solution to establish the concentration of the first energetic material; adding a volume of water in a pre-specified volume ratio of water to the first solution to form a second solution; stirring the second solution to facilitate precipitation of the first energetic material as a major component of a precipitate; separating the precipitate from the second solution; and drying the separated precipitate, such that varying the pre-specified volume of water permits a user to vary yield and purity of the final product.

In select embodiments of the present invention for the above method the pre-specified volume of water is about 0.5 to about 4.0 times that of the volume of the first solution.

In select embodiments of the present invention the above method employs a concentration of the first energetic material of about 80% to about 95% by weight of the saturation concentration of the first energetic material in the first solution.

In select embodiments of the present invention the above method includes stirring the second solution for about ½ hour to about two hours.

In select embodiments of the present invention the above method further entails analyzing the dried precipitate to establish the yield of first and second energetic materials in the final product.

In select embodiments of the present invention the pre-specified solvent comprises the following characteristics: low vapor pressure as evidenced by a boiling point less than about 90° C. and enthalpy of evaporation of about 30 kJ to about 35 kJ; good transport properties, such as ready diffusivity and low viscosity at room temperature (20° C.-25° C.) and ambient pressure; miscibility with water; and relatively low cost.

Select embodiments of the present invention establish a method of altering a compound comprising primarily RDX and HMX to adjust yield and concentration of RDX in a final product resultant from employing said method. Select embodiments of the present invention comprise: adding sufficient acetonitrile (ACN) to the compound to form an ACN solution of the compound; adding a volume of water in a pre-specified volume ratio of water to the ACN solution to form a diluted ACN solution; stirring the diluted ACN solution to facilitate precipitation of RDX as a major component of a precipitate; separating the precipitate; and drying the resultant precipitate, such that varying the pre-specified volume ratio permits a user to vary yield and purity of the final product.

In select embodiments of the present invention the method sufficient ACN comprises an amount that forms the ACN solution at a concentration of RDX of about 80% to about 95% by weight in ACN.

In select embodiments of the present invention the pre-specified volume of water is about 0.5 to about 4.0 times that of the volume of ACN solution. In select embodiments of the present invention the volume of water is about 0.5 to about 1.87 times that of the volume of ACN solution. In select embodiments of the present invention the volume of water is about 0.5 to about 1.0 times that of the volume of ACN solution.

In select embodiments of the present invention the diluted ACN solution is stirred for about ½ hour to about two hours.

In select embodiments of the present invention the ACN solution is analyzed prior to the addition of a pre-specified volume of water to determine the concentration of RDX.

In select embodiments of the present invention the precipitate is analyzed to establish the percent yield of RDX and HMX.

In select embodiments of the present invention a method of altering a compound comprising primarily RDX and HMX to adjust yield and concentration of RDX in a final product resultant from employing the method comprises: combining the compound with acetonitrile (ACN) to form an ACN solution having a concentration of RDX of about 80% to about 95% by weight of the saturation concentration of RDX in ACN; adding a volume of water in a pre-specified volume ratio of water of about 0.5 to about 4.0 times that of the ACN solution to form a diluted ACN solution; stirring the diluted ACN solution to facilitate precipitation of RDX as a major component of a precipitate; separating the precipitate; and drying the precipitate, such that varying the pre-specified volume of water permits a user to vary yield and purity of the final product.

In the above select embodiments of the present invention the pre-specified volume of water is about 0.5 to about 1.87 times that of the ACN solution. In the above select embodiments of the present invention the pre-specified volume of water is about 0.5 to about 1.0 times that of the ACN solution.

In the above select embodiments of the present invention the ACN solution is analyzed prior to adding the water to determine the concentration of RDX.

In the above select embodiments of the present invention the dried precipitate is analyzed for percent yield of RDX and said HMX.

In select embodiments of the present invention, a method of altering a compound comprising primarily RDX and HMX to adjust yield and concentration of RDX in a final product resultant from employing the method comprises: combining the compound with acetonitrile (ACN) to form an ACN solution having a concentration of RDX of about 80% to about 95% by weight of the saturation concentration of RDX in ACN; analyzing a sample of the ACN solution to establish the concentration of RDX; adding a volume of water in a pre-specified volume ratio of water of about 0.5 to about 4.0 times that of the ACN solution to form a diluted ACN solution; stirring the diluted ACN solution for about ½ hour to about two hours to facilitate precipitation of RDX as a major component of a precipitate; separating the precipitate from the ACN solution; drying the separated precipitate; and analyzing the dried precipitate to establish the yield of RDX and HMX therein, such that varying the pre-specified volume of water permits a user to vary yield and purity of the final product.

Refer to FIG. 1, a block diagram representing basic steps used in a process embodied in select embodiments of the present invention. A compound comprising primarily at least two energetic materials is dissolved in a suitable "good" solvent 101, shown in FIG. 1 to be ACN. The content of the resultant solution (solvent plus compound) than may be analyzed 102 to establish the percent of desired final product therein. Next, water is added and the diluted solution stirred 103 until a precipitate is formed 104. The precipitate is filtered (separated) from the stirred dilute solution and dried 105 and the final product analyzed 106 for yield percentage and purity of the final product.

For select embodiments of the present invention, one method of purifying a compound of RDX and HMX with a typical concentration of about 88% to about 92% RDX and about 8% to about 12% HMX, involves dissolving an amount of the compound in ACN to yield RDX of about 80% to about 95% weight by volume of the saturation concentration of RDX in ACN at ambient pressure and temperature (about 20° C. to about 25° C.). Next, a pre-specified volume of water is added to a pre-specified amount of the ACN solution and the resulting "diluted" solution is stirred for a pre-specified period, resulting in precipitation of RDX. The volume of water added to the ACN solution is about 0.5 to about 4.0 times that of the volume of the ACN solution. In select embodiments of the present invention, the volume of water added is about 0.5 to about 1.87 times that of the volume of the ACN solution. In select embodiments of the present invention, preferably the volume of water added to the ACN solution is about 0.5 to about 1.0 times that of the volume of the ACN solution. In select embodiments of the present invention, after combining the ACN solution with water, the "water diluted" resultant solution is stirred, preferably for a period of about ½ hour to about 2 hours, to ensure complete precipitation of the RDX.

EXAMPLE I

A homogenous stock solution was prepared by dissolving 40.01 grams of a compound comprising RDX and HMX as primary components in ACN to make 1000 ml of an ACN solution. The ACN solution was analyzed using high performance liquid chromatography (HPLC) using an Acclaim E1 Explosive column (Dionex ICS-3000)) coupled to an ultraviolet detector (UVD170U). Analysis showed that the RDX/HMX compound contained 91.6% RDX and 8.4% HMX. Water was added to seven 50 ml capped vials of the ACN solution in different volumes (25, 50, 75, 100, 150, 200, 250 ml). All water used in the examples was filtered and deionized. The seven vials were stirred for about 30 minutes on a magnetic stirrer. A precipitate was formed in each vial. The vials were kept at room temperature (23±0.5° C.) for about two hours. The precipitate was then separated by filtration using Whatman filter paper. The filtered precipitate was dried in air for about 48 hours and weighed. Next, a small amount of the precipitate was dissolved in ACN and analyzed for composition using the HPLC. The percent yield of precipitate and the concentration of RDX and HMX in the precipitate were determined for each of the seven vials with results summarized in Table 2. As can be seen, quite a loss in % Yield is taken in going from a 96.9% pure RDX at 91.6% yield to a 99.2% pure RDX at 72.7% yield and an even more significant loss in % Yield is taken in going from 99.2% pure RDX to 100% pure RDX at 42.4% yield.

TABLE 2

Compositions and yields of purified RDX and HMX.

| ACN Solution (ml) | Water (ml) | Ratio of Water to ACN Solution | % Yield of precipitate* | Feed solution % RDX | Feed solution % HMX | Precipitated solid % RDX | Precipitated solid % HMX |
|---|---|---|---|---|---|---|---|
| 50 | 25 | 0.5 | 42.4 | 91.6 | 8.4 | 100 | 0 |
| 50 | 50 | 1 | 72.7 | 91.6 | 8.4 | 99.2 | 0.8 |
| 50 | 75 | 1.5 | 91.6 | 91.6 | 8.4 | 96.9 | 3.1 |
| 50 | 100 | 2 | 98.8 | 91.6 | 8.4 | 93.1 | 6.9 |
| 50 | 150 | 3 | 98.7 | 91.6 | 8.4 | 92.6 | 7.4 |
| 50 | 200 | 4 | 100 | 91.6 | 8.4 | 91.4 | 8.6 |
| 50 | 250 | 5 | 100 | 91.6 | 8.4 | 91.4 | 8.6 |

*% Yield = [Weight of precipitate/(Weight of RDX + HMX originally)] × 100.

Figure 2:
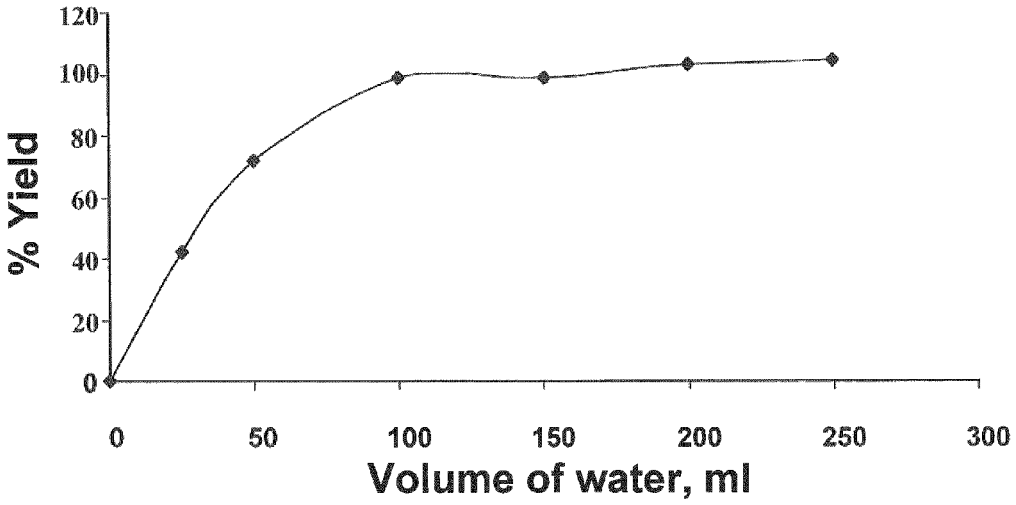
FIG. 2 is a line graph comparing the percentage yield in a final product versus volume of water mixed with an RDX/HMX product dissolved in acetonitrile (ACN).
Figure 3:
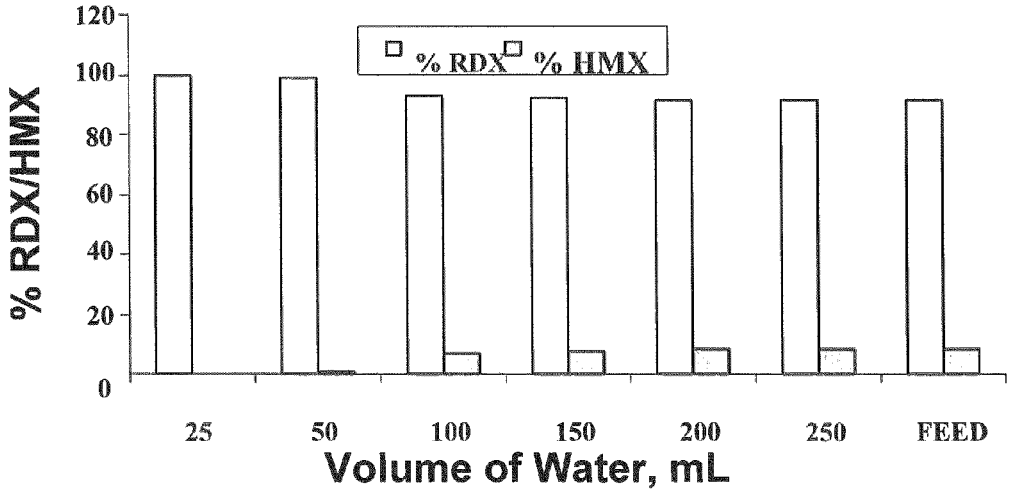
FIG. 3 is a bar graph comparing the percentage of RDX and HMX in a final product versus volume of water mixed with an RDX/HMX product dissolved in ACN.

Further, refer to FIG. 2, a line graph representing % Yield data from Table 2. As the volume of added water increased, the yield of the precipitate increased correspondingly with 100% yield obtained when the vial contents was mixed with 200 ml of water but the precipitate contained the same ratio of RDX and HMX as originally provided as can be seen most readily in the bar graph of FIG. 3 in which both the 200 and 250 mL additions of water achieved the same amount of HMX in the precipitate as in the original "Feed" compound. That is, the percent yield of RDX in the precipitate decreased and the percent of HMX increased as the volume of water increased above about a 1:1 ratio (50 mL) of water to ACN solution. Therefore, added water volumes of between about 50 ml and about 100 ml (1:1 to 2:1 ratio of water to ACN solution) would be chosen as an optimum range to achieve a relatively high % Yield (72.7-98.8) with a relatively high concentration (99.2-93.1, respectively) of RDX in the precipitate. The experiments were repeated with 50 ml of the original ACN solution and 50 ml of water four times and the % RDX in the precipitate was 99.2, 99.1, 99.2 and 99.3, respectively. The data show that a small amount of water added to the ACN solution preferentially displaces (yields) RDX.

EXAMPLE II

To 2.5 ml of a compound comprising primarily RDX and HMX in solution with ACN, 2.5 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 71.6%, containing 99.7% RDX and 0.3% HMX, a figure consistent with that of Example I (72.7%; 992%) with the same 1:1 "dilution ratio" but a 20 times larger sample volume.

EXAMPLE III

To 5.0 ml of a compound comprising primarily RDX and HMX in solution with ACN, 5.0 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 73.4%, containing 99.6% RDX and 0.4% HMX, a figure consistent with that of Example I (72.7%; 99.2%) with the same 1:1 "dilution ratio" but a 10 times larger sample volume and Example II (71.6%; 99.7%) with the same 1:1 "dilution ratio" but half the sample volume.

EXAMPLE IV

To 50 ml of a compound comprising primarily RDX and HMX in solution with ACN, 50 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 72.4%, containing 99.2% RDX and 0.8% HMX, a figure consistent with that of Example I (72.7%; 99.2%) with the same 1:1 "dilution ratio" and sample volume; Example II (71.6%; 99.7%) with the same 1:1 "dilution ratio" but 20 times the sample volume and Example III with the same 1:1 "dilution ratio" but 10 times the sample volume.

EXAMPLE V

To 50 ml of a compound comprising primarily RDX and HMX in solution with ACN, 50 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 71.9%, containing 99.1% RDX and 0.8% HMX, a figure consistent with that of Example I (72.7%; 99.2%) with the same 1:1 "dilution ratio" and sample volume; Example II (71.6%; 99.7%) with the same 1:1 "dilution ratio" but 20 times the sample volume; Example III with the same 1:1 "dilution ratio" but 10 times the sample volume, and Example IV (72.4%; 99.2%) with the same 1:1 "dilution ratio" and sample volume.

EXAMPLE VI

To 50 ml of a compound comprising primarily RDX and HMX in solution with ACN, 50 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 72.7%, containing 99.2% RDX and 0.8% HMX, a figure equal that of Example I (72.7%; 99.2%) with the same 1:1 "dilution ratio" and sample volume; Example II (71.6%; 99.7%) with the same 1:1 "dilution ratio" but 20 times the sample volume; Example III with the same 1:1 "dilution ratio" but 10 times the sample volume, Example IV (72.4%; 99.2%) with the same 1:1 "dilution ratio" and sample volume; and Example V (71.9%; 99.1%) with the same 1:1 "dilution ratio" and sample volume.

EXAMPLE VII

To 50 ml of a compound comprising primarily RDX and HMX in solution with ACN, 50 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 72.1%, containing 99.3% RDX and 0.8% HMX, a figure near that of Example I (72.7%; 99.2%) with the same 1:1 "dilution ratio" and sample volume; Example II (71.6%; 99.7%) with the same 1:1 "dilution ratio" but 20 times the sample volume; Example III with the same 1:1 "dilution ratio" but 10 times the sample volume, Example IV (72.4%; 99.2%) with the same 1:1 "dilution ratio" and sample volume; Example V (71.9%; 99.1%) with the same 1:1 "dilution ratio" and sample volume; and Example VI (72.7%; 99.2%) with the same 1:1 "dilution ratio" and sample volume.

EXAMPLE VIII

To 50 ml of a compound comprising primarily RDX and HMX in solution with ACN, 25 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 42.4%, containing 100% RDX, a figure equal to that of Example I (42.4%; 100%) with the same 0.5:1 "dilution ratio" and sample volume.

EXAMPLE IX

To 50 ml of a compound comprising primarily RDX and HMX in solution with ACN, 100 ml of water was added. The resultant "diluted ACN solution" was stirred for about 30 minutes. Precipitate formation was observed. The resultant precipitate was separated by filtration and air dried. The total precipitate was analyzed for RDX and HMX content. The % Yield of precipitate was 98.8%, containing 93.1% RDX, a figure equal to that of Example I (98.8%; 93.1%) with the same 2:1 "dilution ratio" and sample volume.

These examples demonstrate that by varying the amount of water added to the ACN solution both the amount and purity of RDX precipitated may be controlled. Specifically, as more water is added above a ratio of about 0.5:1 of water to the ACN solution, the total yield of the precipitate increased while the purity of the RDX precipitate decreased. Thus, based on the above examples, a 1:1 ratio of water to the ACN solution may be a best compromise between yield and purity of RDX. If purity is preferred over yield then a smaller volume of water may be added to the volume of ACN solution, on the order of about 0.5:1 water:ACN solution. Alternatively, if a higher yield of RDX is preferred while still providing a purity of RDX of almost 97%, a volume of water may be added to the volume of stock solution used, on the order of about 1.5:1 (water:ACN solution).

In addition to the option of varying purity and yield of RDX provided by select embodiments of the present invention, e other advantages exist. For example, select embodiments of the present invention do not require modifications to the current industrial Bachmann Process, select embodiments of the present invention being an addition to an existing process. Further, simple relatively environmentally benign and inexpensive solvents suitable for recycling are used, such as acetonitrile and water. Since select embodiments of the present invention may be conducted at room temperature, energy requirements are also minimized.

The abstract of the disclosure is provided to comply with the rules requiring an abstract that will allow a searcher to quickly ascertain the subject matter of the technical disclosure of any patent issued from this disclosure. (37 CFR §1.72 (b)). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for modifying the yield and purity of a specific energetic, i.e., RDX, it may be used for any type of energetic compound that is included in a mixture in which one wishes to efficiently and cost effectively precipitate out a target energetic compound. Thus select embodiments of the present invention may be useful in such diverse applications as manufacturing, refining, re-cycling, remediating, improving operational safety, and the like. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A method of altering a compound comprising primarily RDX and HMX to adjust yield and concentration of RDX in a final product resultant from employing said method, comprising:

adding sufficient acetonitrile (ACN) to said compound to form an ACN solution of said compound;

adding a volume of water in a pre-specified volume ratio of said water to said ACN solution to form a diluted said ACN solution;

stirring said diluted ACN solution to facilitate precipitation of said RDX as a major component of a precipitate;

separating said precipitate from said diluted ACN solution; and drying said separated precipitate, wherein varying said pre-specified volume ratio permits a user to vary yield and purity of said final product.

2. The method of claim 1 in which said sufficient ACN comprises an amount that forms said ACN solution at a concentration of said RDX of about 80% to about 95% by weight in ACN.

3. The method of claim 1 in which said pre-specified volume of water is about 0.5 to about 4.0 times that of said volume of said ACN solution.

4. The method of claim 3 in which said volume of water is about 0.5 to about 1.87 times that of said volume of said ACN solution.

5. The method of claim 3 in which said volume of water is about 0.5 to about 1.0 times that of said volume of said ACN solution.

6. The method of claim 1 stirring said diluted ACN solution for about ½ hour to about 2 hours.

7. The method of claim 1 in which said ACN solution is analyzed prior to said addition of a pre-specified volume of water to determine the concentration of said RDX.

8. The method of claim 1 further analyzing said precipitate to establish the percent yield of at least each of said RDX and said HMX.

9. A method of altering a compound comprising primarily RDX and HMX to adjust yield and concentration of RDX in a final product resultant from employing said method, comprising:

combining said compound with acetonitrile (ACN) to form an ACN solution having a concentration of RDX of about 80% to about 95% by weight of the saturation concentration of RDX in ACN;

adding a volume of water in a pre-specified volume ratio of said water of about 0.5 to about 4.0 times of that of said ACN solution to form a diluted said ACN solution;

stirring said diluted ACN solution to facilitate precipitation of said RDX as a major component of a precipitate;

separating said precipitate from said diluted ACN solution; and drying said separated precipitate, wherein varying said pre-specified volume of water permits a user to vary yield and purity of said final product.

10. The method of claim 9 in which said pre-specified volume of water is about 0.5 to about 1.87 times that of said volume of said ACN solution.

11. The method of claim 9 in which said pre-specified volume of water is about 0.5 to about 1.0 times that of said volume of said ACN solution.

12. The method of claim 9 in which said ACN solution is analyzed prior to adding said water to determine the concentration of said RDX.

13. The method of claim 9 in which said dried precipitate is analyzed for percent yield of at least said RDX and said HMX.

14. A method of altering a compound comprising primarily RDX and HMX to adjust yield and concentration of RDX in a final product resultant from employing said method, comprising:

combining said compound with acetonitrile (ACN) to form an ACN solution having a concentration of RDX of about 80% to about 95% by weight of the saturation concentration of RDX in ACN;

analyzing a sample of said ACN solution to establish the concentration of said RDX;

adding a volume of water in a pre-specified volume ratio of said water of about 0.5 to about 4.0 times of that of said ACN solution to form a diluted said ACN solution;

stirring said diluted ACN solution for about ½ hour to about two hours to facilitate precipitation of said RDX as a major component of a precipitate;

separating said precipitate from said diluted ACN solution;

drying said separated precipitate; and analyzing said dried precipitate to establish at least the yield of said RDX and said HMX therein, wherein varying said pre-specified volume of water permits a user to vary yield and purity of said final product.

15. A method of altering a compound comprising primarily a first and a second energetic material to adjust yield and concentration of said first energetic material in a final product resultant from employing said method, comprising:

combining said compound with a pre-specified solvent to form a first solution;

analyzing a sample of said first solution to establish the concentration of said first energetic material;

adding a volume of water in a pre-specified volume ratio of said water to that of said first solution to form a second solution;

stirring said second solution to facilitate precipitation of said first energetic material as a major component of a precipitate;

separating said precipitate from said second solution; and drying said separated precipitate, wherein varying said pre-specified volume of water permits a user to vary yield and purity of said final product.

16. The method of claim 15 in which said pre-specified volume of water is about 0.5 to about 4.0 times that of said volume of said first solution.

17. The method of claim 15 employing a concentration of said first energetic material of about 80% to about 95% by weight of the saturation concentration of said first energetic material in said first solution.

18. The method of claim 15 stirring said second solution for about ½ hour to about two hours.

19. The method of claim 15 analyzing said dried precipitate to establish at least the yield of said first energetic material and said second energetic material therein.

20. The method of claim 15 said pre-specified solvent comprising at least the following characteristics:

low vapor pressure as evidenced by a boiling point less than about 90° C. and enthalpy of evaporation of about 30 kJ to about 35 kJ;

good transport properties, such as ready diffusivity and low viscosity at room temperature (20° C.-25° C.) and ambient pressure;

miscible with water; and inexpensive.

* * * * *